US008714512B2

(12) United States Patent
Schwoerer

(10) Patent No.: US 8,714,512 B2
(45) Date of Patent: May 6, 2014

(54) DEVISIBLE CLIMBING SHOE OF A CLIMBING FORMWORK

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 1018 days.

(21) Appl. No.: 11/993,024

(22) PCT Filed: Jun. 20, 2006

(86) PCT No.: PCT/DE2006/001045

§ 371 (c)(1),
(2), (4) Date: Dec. 19, 2007

(87) PCT Pub. No.: WO2007/000136

PCT Pub. Date: Jan. 4, 2007

(65) Prior Publication Data

US 2009/0146041 A1 Jun. 11, 2009

(30) Foreign Application Priority Data

Jun. 29, 2005 (DE) ..... 10 2005 030 333

(51) Int. Cl.
*E04G 9/00* (2006.01)

(52) U.S. Cl.
USPC ..... 249/20; 425/63; 249/18; 182/82; 182/87

(58) Field of Classification Search
USPC ..... 182/2.1, 2.2, 2.3, 82, 87; 249/18–22; 425/63, 65; 264/33
See application file for complete search history.

(56) References Cited

U.S. PATENT DOCUMENTS

| | | | | |
|---|---|---|---|---|
| 4,290,576 | A | 9/1981 | Schwoerer | |
| 4,962,828 | A * | 10/1990 | Duncan | 182/82 |
| 5,630,482 | A | 5/1997 | Schwoerer | |
| 2003/0052249 | A1 | 3/2003 | Waldschmitt et al. | |
| 2005/0217934 | A1 | 10/2005 | Choo | |

FOREIGN PATENT DOCUMENTS

| | | | | |
|---|---|---|---|---|
| EP | 0 034 819 | | 9/1981 | |
| FR | 2 298 662 | | 8/1976 | |
| FR | 2 487 410 | | 1/1982 | |
| FR | 2 487 892 | | 2/1982 | |
| KR | 1020020047071 | | 6/2002 | |
| KR | 1020020062259 | | 7/2002 | |
| RU | 2078884 | | 5/1997 | |
| SU | 968262 | | 10/1982 | |
| WO | WO 03/097493 | | 11/2003 | |
| WO | WO 2004/020766 | | 3/2004 | |
| WO | WO 2004020766 | A1 * | 3/2004 | E04G 21/32 |

* cited by examiner

*Primary Examiner* — Katherine Mitchell
*Assistant Examiner* — Daniel Cahn
(74) *Attorney, Agent, or Firm* — Paul Vincent

(57) ABSTRACT

A climbing shoe (10) of a climbing formwork for fixing to a concreting section (14) of a building comprises a sliding shoe part (16) on which claws (50) are provided. At least one claw (50) is provided in a pivotal and/or telescopic manner on the sliding shoe part (16).

4 Claims, 8 Drawing Sheets

DEVISIBLE CLIMBING SHOE OF A CLIMBING FORMWORK

This application is the national stage of PCT/DE2006/001045 filed on Jun. 20, 2006 and also claims Paris Convention priority to DE 10 2005 030 333.1 filed on Jun. 29, 2005.

BACKGROUND OF THE INVENTION

The invention relates to a climbing shoe of a climbing formwork for fixing to a concreting section of a building which retains a climbing rail guided along the wall of a building to be erected in pre-erected concreting sections. Climbing shoes are known which embrace a climbing rail in such a manner that on the one hand, they are displaceable in the climbing shoes and on the hand the climbing rails are held in a guided manner on the wall of a building. If the climbing shoe is to be removed from the wall, the climbing rails must be withdrawn from the climbing shoes and then it is possible to dismount the climbing shoes which are affixed at provided anchor points of a concreting section.

It is the object of the invention to provide a climbing shoe which can be removed from a stationary fixing on a concreting section even when a climbing rail passes therethrough.

The object is achieved by a climbing shoe which comprises a sliding shoe part on which claws are provided which hold a climbing rail disposed displaceably between the claws in a guided manner, whereby the claws embrace partial sections of the climbing rail and wherein at least one claw is provided in a pivotal and/or telescopic manner on the sliding shoe part.

SUMMARY OF THE INVENTION

If one claw on the sliding shoe part is configured pivotally and/or telescopically on the sliding shoe part, the climbing shoe according to the invention among a plurality of climbing shoes attached to a building can always be removed from a wall when it is no longer required in use for the provided climbing formwork. This is always the case when one concreting section is completed and a new concreting section is to be erected. The climbing rails used for the climbing formwork have a length greater than the height of two concreting sections to be erected. Consequently, the lowermost climbing shoes must always remain on the wall to be erected until the climbing rails have climbed so high that they completely release the lowermost climbing shoes. When the climbing rails are out of engagement with the climbing shoes, these climbing shoes can be dismounted. Auxiliary platforms or follow-up platforms are usually required for dismounting this climbing shoe known from the prior art and a fairly large supply of climbing shoes is required for the correct operation of a climbing formwork known from the prior art so that the known climbing formworks can be operated.

If climbing shoes according to the invention are used, additional follow-up platforms are superfluous for dismounting climbing shoes which are no longer required because these climbing shoes can be dismounted from a wall whilst they are still in engagement with the climbing rails. If necessary, the climbing shoe according to the invention can also be attached at an arbitrary position on a climbing rail. All the advantages obtained during dismounting of a climbing shoe from a climbing rail can be applied to the mounting of a climbing shoe on a climbing rail.

A particular embodiment of a climbing shoe makes it possible to dismount the climbing shoe if two claws of a climbing shoe embrace the climbing rail in partial sections of the climbing rail and one claw is fixed pivotally on the sliding shoe part. A pivotal bearing can be formed simply and cost-effectively on a claw of the sliding shoe and the pivoting movement can be stopped extremely simply by means of a locking bolt. When the locking bolt is removed, the claw can be pivoted out and removed from the climbing rail. When the claw is pivoted out, it can also be blocked by means of the same locking bolt so that it is ensured that during dismounting of the pivotal claw, said claw does not pivot uncontrollably.

If the climbing shoe according to the invention is configured as a sliding shoe part and as a wall or slab shoe part which are detachably connected to one another by means of a horizontally aligned stub shaft, dismounting of a climbing shoe is even simpler because it can be additionally divided in addition to the pivotal claw.

In a further embodiment of the invention, the climbing shoe has a vertically aligned axis in the wall shoe part. This has the advantage that the climbing shoe can also be aligned at rounded walls of concreting sections in such a manner that adjacent climbing shoes always align the climbing rails held in the climbing shoes and the consoles associated therewith parallel to one another. This has the advantage that carriages, which accommodate formwork walls, for example, can be driven towards the wall or driven away from the wall on the consoles or rails.

BRIEF DESCRIPTION OF THE DRAWINGS

In the following figures, the climbing shoe according to the invention is shown and described in an embodiment.

In the figures.

Figure 1:
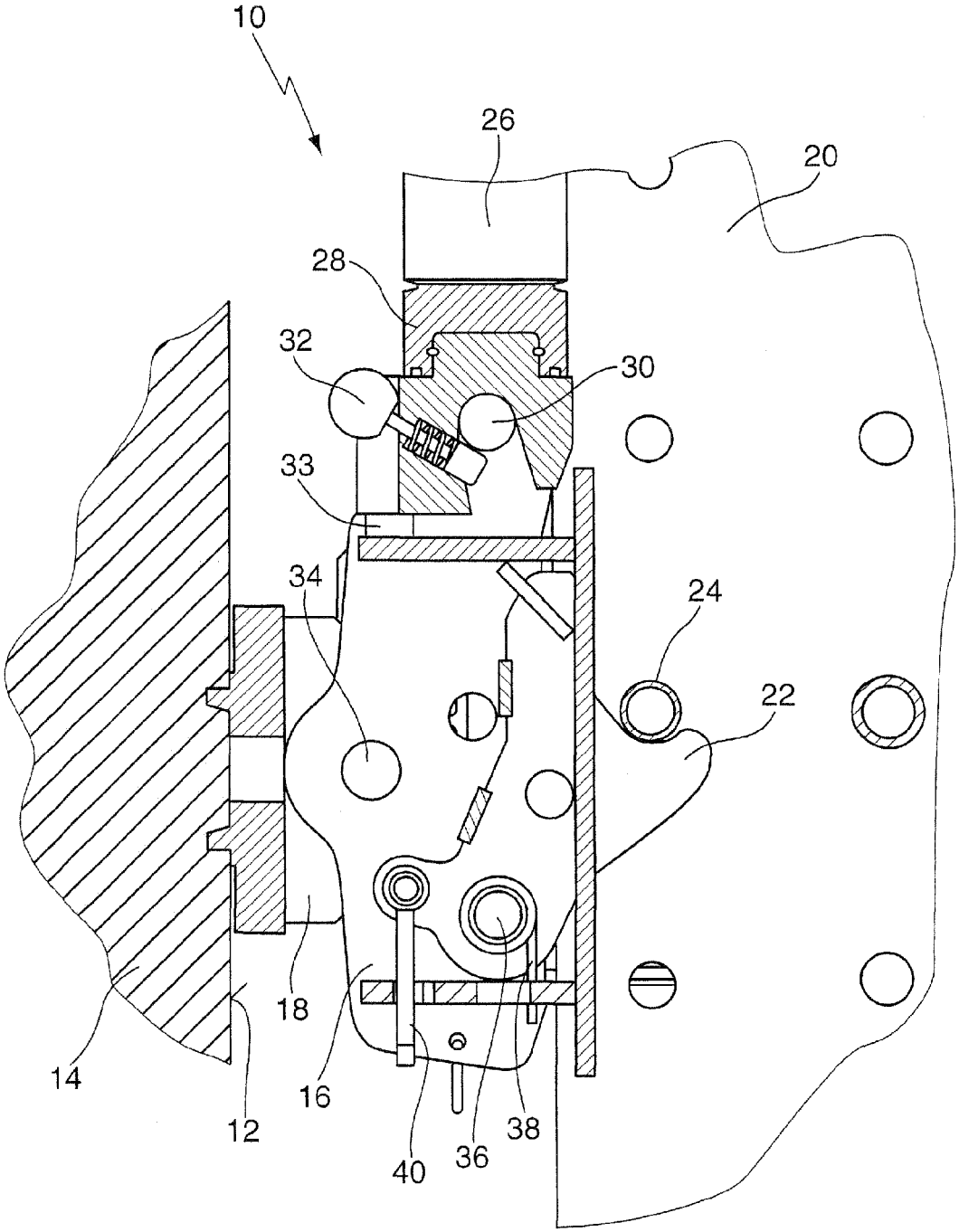
FIG. 1 shows a section through a climbing shoe according to the invention as it is attached in a fixed position on a concreted wall and guides and holds a climbing rail such that it cannot be displaced.

The figures show the embodiments according to the invention highly schematically and should not be understood as being to scale.

DESCRIPTION OF THE PREFERRED EMBODIMENTS

The same functional elements are largely characterised by the same reference numerals in the figures described hereinafter. These functional elements can be configured substantively differently.

FIG. 1 shows in a side view and partially cutaway view a climbing shoe 10 as attached to a wall 12 of a concreting section 14 in a fixed position at an anchor point. The climbing shoe 10 is composed of a sliding shoe part 16 and a wall shoe part 18. A climbing rail 20 is carried by means of a catch 22 of the sliding shoe part 16 and is guided laterally by the catch 22 gripping under a bearing bolt 24 of the climbing rail 20. The catch 22 is shown in its maximum possible deflection and substantively formed counter-bearings inside the sliding shoe part 16 prevent any further deflection of the catch 22 in the clockwise direction.

A climbing cylinder 26 is placed on the sliding shoe part 16 of the climbing shoe 10. Of the climbing cylinder 26, only the lowermost part of the cylinder can be seen which adjoins a housing 28 via which the climbing cylinder 26 is placed on an articulated shaft 30 of the climbing shoe 10. A safety bolt 32 fixes the housing 28 on the articulated shaft 30 without hindering the pivoting region of the climbing cylinder 26 about the articulated shaft 30. When the safety bolt 32 is pulled against a spring force from engagement with the articulated shaft 30, the climbing cylinder 26 can be withdrawn from the articulated shaft 30. The housing 28 of the climbing cylinder 26 is supported on a housing wall of the sliding shoe part 16 by means of a rubber or viscous elastic element 33.

The sliding shoe part 16 is connected to the wall shoe part 18 in an articulated manner by means of a horizontally aligned stub shaft 34. The sliding shoe part 16 can be pivoted about the stub shaft 34 with respect to the wall shoe part 18.

Inside the sliding shoe part 16, the catch 22 can be pivoted about a pivot point 36 against the pressure of a spring 38 in the anticlockwise direction.

If the catch 22 is not weight-loaded by means of the bearing bolt 24 of the climbing rail 20, the catch 22 can be pivoted manually by means of the lever 40 against the pressure of the spring 38 into the sliding shoe part 16. This is necessary whenever the climbing rail 20 is to be moved downwards with respect to the fixedly arranged climbing shoe 10.

Only small sections of the concreting section 14, the climbing rail 20 and the climbing cylinder 26 are shown in the figure.

Figure 2:
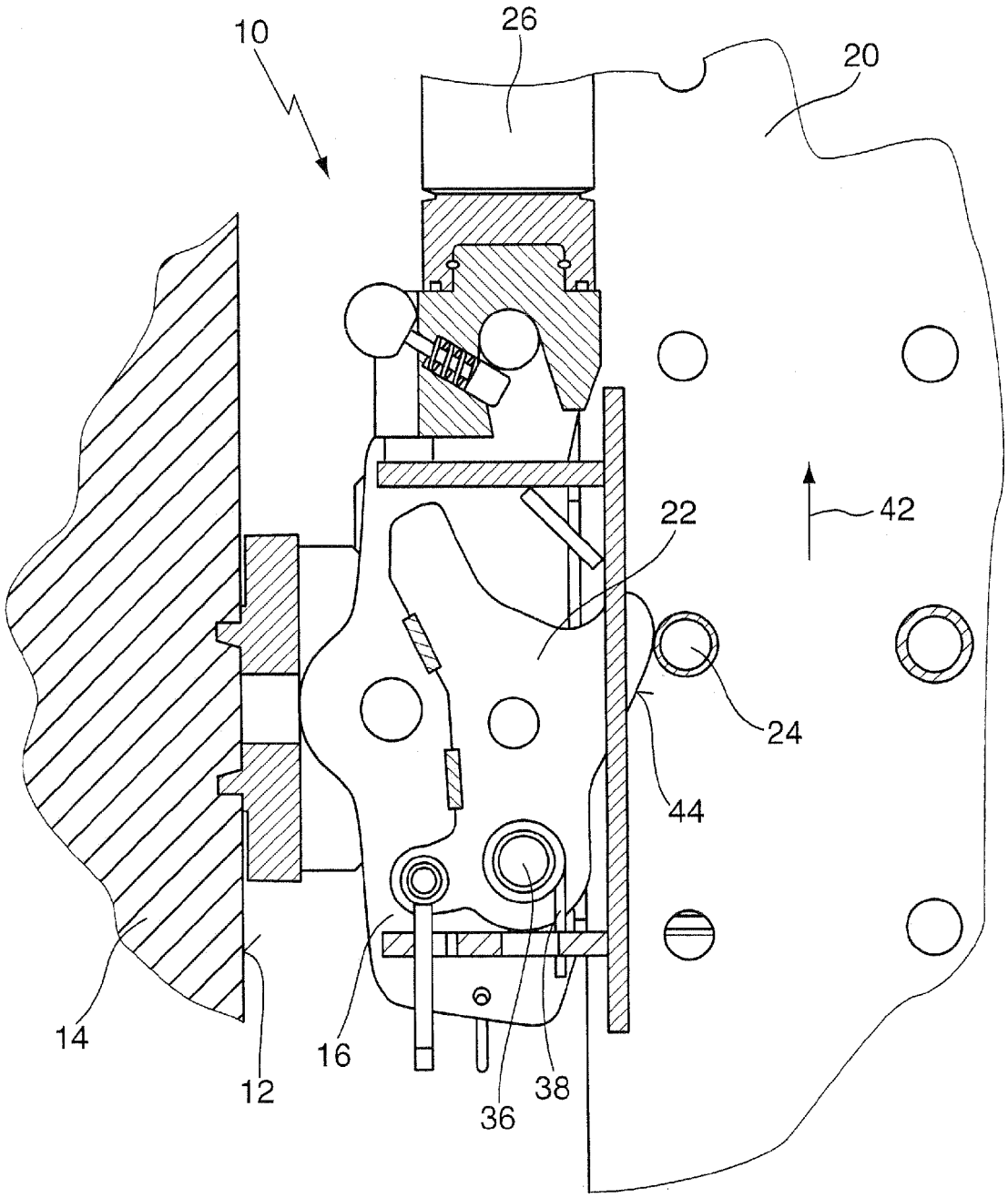
FIG. 2 shows a section through a climbing shoe according to the invention with a catch pivoted into the climbing shoe.

FIG. 2 shows a snapshot of the climbing rail 20 as it is displaced in an upward direction by means of the climbing cylinder 26 along a wall 12 of the concreting section 14 in the direction of the arrow 42. For this climbing process of the climbing rail 20 in the direction of the arrow 42, the piston of the climbing cylinder 26 is extended, likewise having a catch at its free end which can grip underneath and support the bearing bolt 24 of the climbing rail 20.

When the climbing rail 20 is moved by means of the climbing cylinder 26 in the direction of the arrow 42, a bearing bolt 24 of the climbing rail 20 presses onto an approach slope 44 of the catch 22 and pivots the catch 22 about the pivot point 36 against the pressure of the spring 38. At the same time, the catch 22 pivots into the sliding shoe part 16 of the climbing shoe 10.

Figure 3:
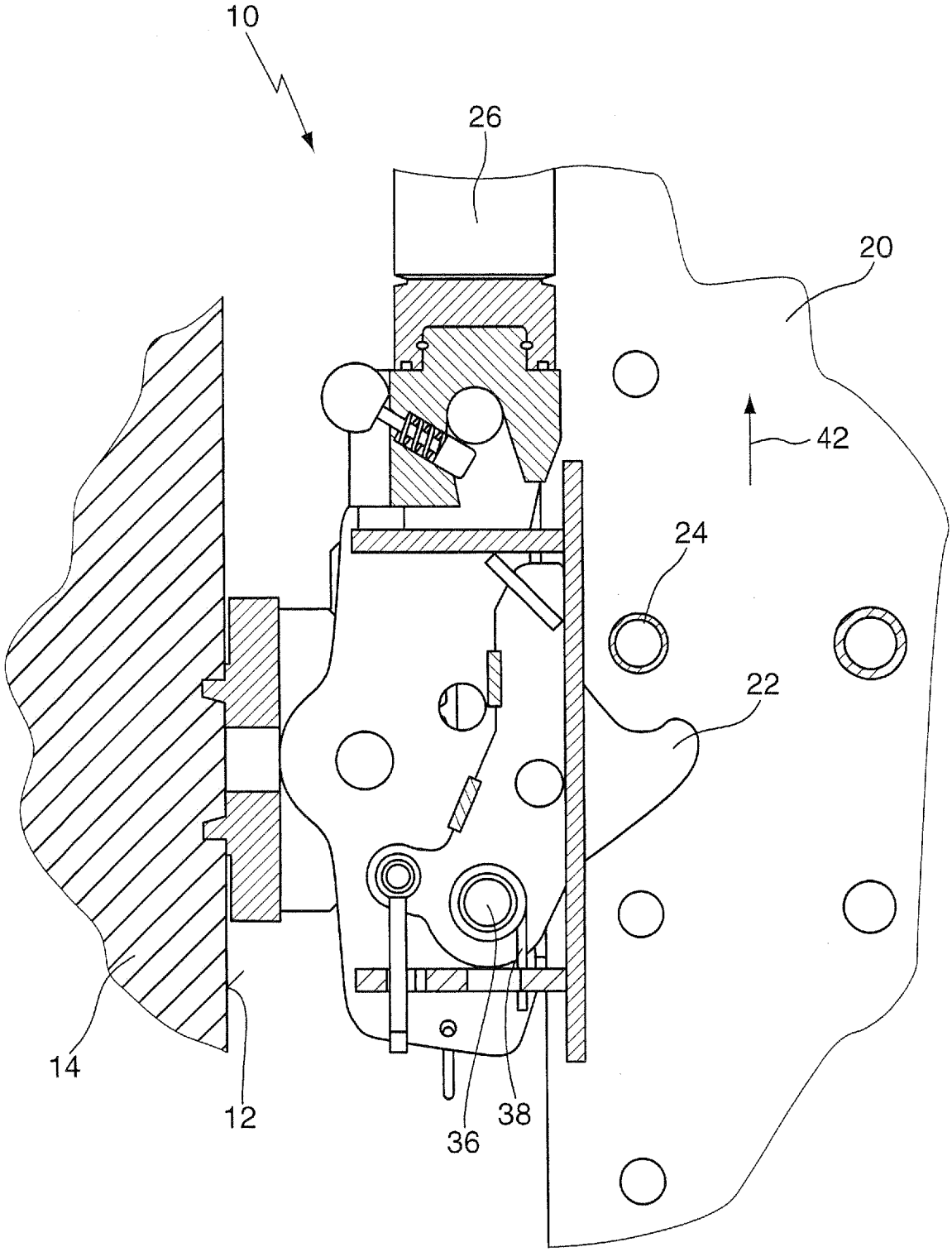
FIG. 3: shows a section through a climbing shoe according to the invention according to FIGS. 1 and 2 with the catch pivoted out from the climbing shoe and free from engagement with a bearing bolt.

FIG. 3 shows the climbing shoe 10 from FIGS. 1 and 2 on the wall 12 of the concreting section 14 as the catch 22 pivots back about the pivot point 36 into its initial position under the pressure of the spring 38. The climbing rail 20 was moved by means of the climbing cylinder 26 further in the direction of the arrow 42 so that the bearing bolt 24 has again released the catch 22 and this could pivot back into its initial position.

When the climbing cylinder 26 is retracted, the bearing bolt 24 rests on the catch 22 and the climbing shoe 10 holds the climbing rail 20 in the position shown in the Figure on the wall 12 of the concreting section 14.

Figure 4:
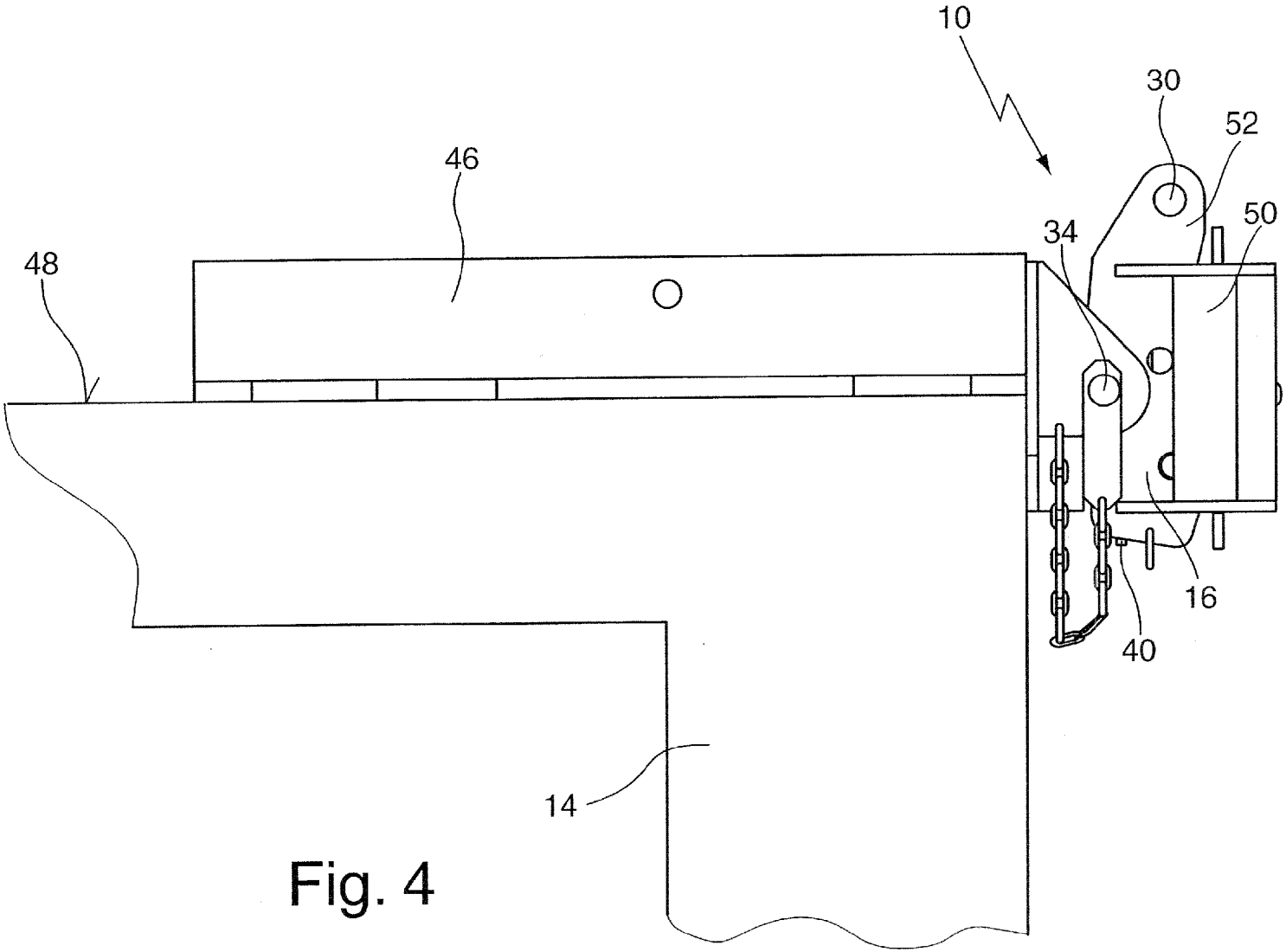
FIG. 4 shows a climbing shoe with a slab shoe part which is placed on the slab of a concreting section and fixed there.

FIG. 4 shows in a side view, a modified climbing shoe 10 which is composed of the sliding shoe part 16 and a slab shoe part 46. The slab shoe part 46 lies on the slab 48 of the concreting section 14 and is fixed in position there. The sliding shoe part 16 is fixed to the slab shoe part 46 in an articulated manner by means of the stub shaft 34. When the stub shaft 34 is removed from the slab shoe part 46, the sliding shoe part 16 with claws 50 can be removed from the slab shoe part 46. The catch or catches of the sliding shoe part 16 which grip underneath bearing bolts of the climbing rail when the climbing rail is inserted or can be pivoted by the bearing bolt during a climbing process, are covered by the claws 50. The lever 40 which is hinged to the catch in the sliding shoe part 16 is shown in the figure and the catch or catches in the sliding shoe part 16 can be pivoted manually by means of the lever 40.

A tab 52 is shown on the sliding shoe part 16 and carries the articulated shaft 30. A climbing cylinder can be placed on the articulated shaft 30.

Figure 5:
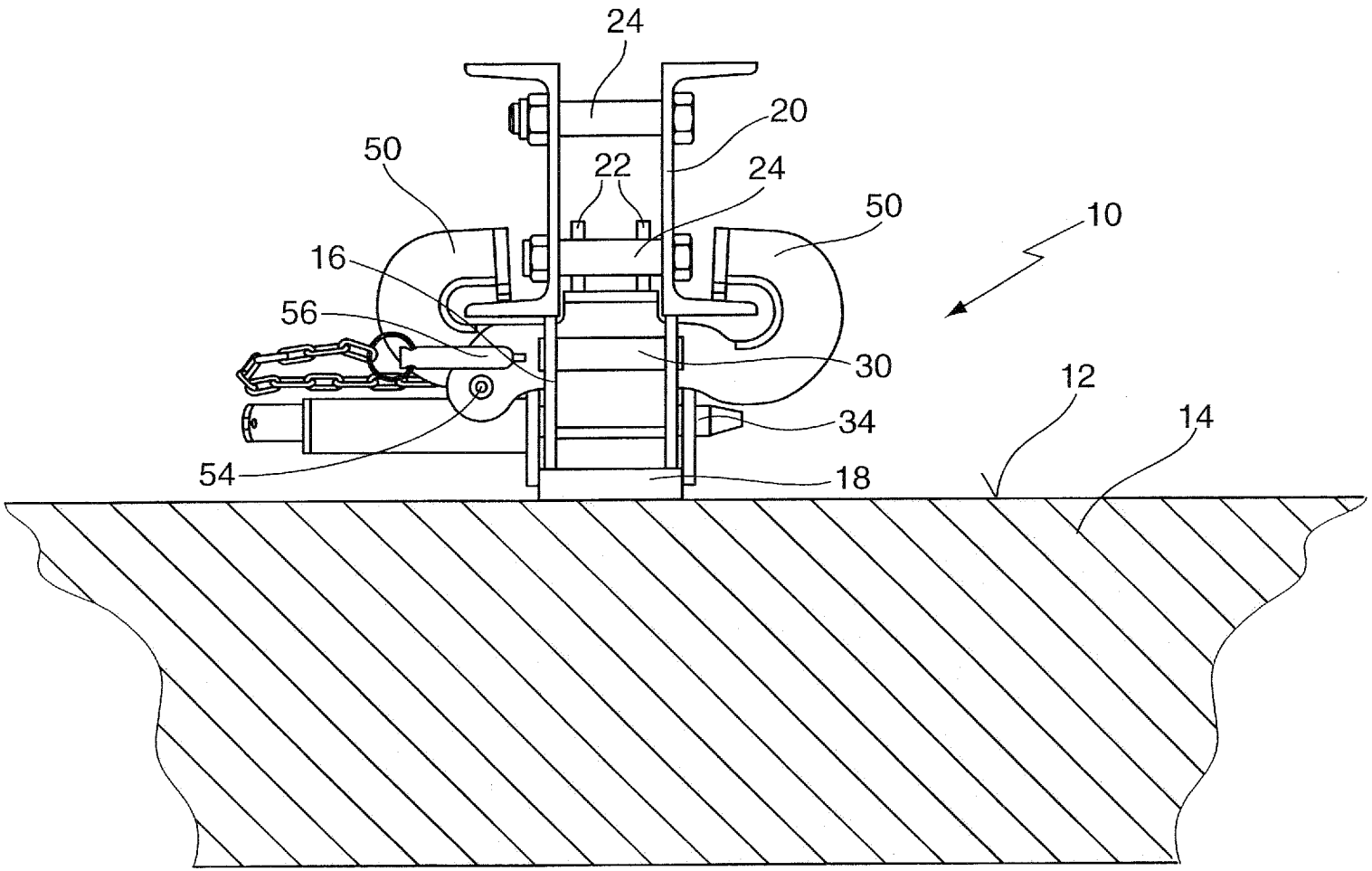
FIG. 5 shows a climbing shoe in plan view as fixed on a concreting section and embracing a climbing rail with claws.

FIG. 5 shows a plan view of the climbing shoe 10 which is composed of a sliding shoe part 16 and a wall shoe part 18 as is affixed in a fixed position to the wall 12 of the concreting section 14. The sliding shoe part 16 is connected to the wall shoe part 18 in an articulated manner by means of the stub shaft 34. The claws 50 embrace the legs of the U-shaped profile of the climbing rails 20 and hold the climbing rail 20 guided on the wall 12. Catches 22 of the sliding shoe part 16 grip underneath the bearing bolt 24 on one side of the climbing rail 20. On the climbing shoe part 16, the articulated shaft 30 is arranged for placement of a climbing cylinder. One half of the claws 50 is pivotable about an axis 54 if the locking bolt 56, which prevents any possible pivoting movement of the left claw 50, is withdrawn from its holder.

Figure 6:
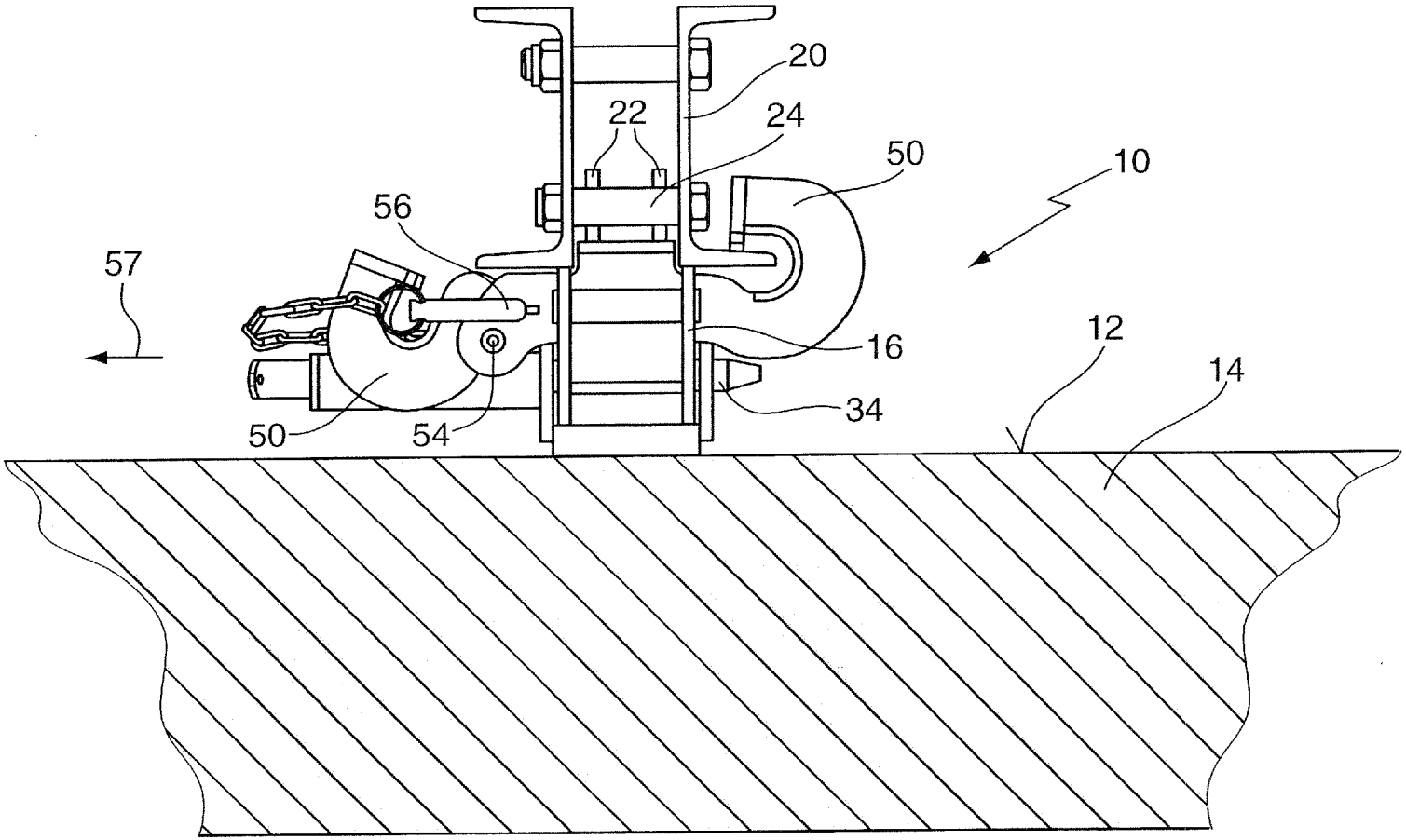
FIG. 6 shows a climbing shoe in plan view as fixed on a concreting section of a wall with a claw open on one side for removal from a climbing rail.

FIG. 6 shows the climbing shoe 10 from FIG. 5 with the claw 50 pivoted open on one side.

If a climbing shoe 10 on a wall 12 of the concreting section 14 is to be dismantled or dismounted in the presence of the climbing rail 20, a claw 50 of the sliding shoe part 16 can be pivoted open if the locking bolt 56 is brought out of engagement from a rigid wall section of the sliding shoe part 16 and is withdrawn from an opening in the claw 50. When the unlocking is released, the claw 50 can be pivoted about the axis 54. When the claw 50 is pivoted open, the locking bolt 56 can be inserted back into its position which locks the claw 50 and it is then ensured that the claw 50 remains in the state shown in the figure. If the stub shaft 34 is then removed between the sliding shoe part 16 and the wall shoe part 18, by withdrawing it from the common mounting in the direction of the arrow 57, the sliding shoe part 16 can be removed from the climbing rail 20. If necessary, the wall shoe part 18 can then be released from its anchor position in the wall 12 and removed.

Figure 7:
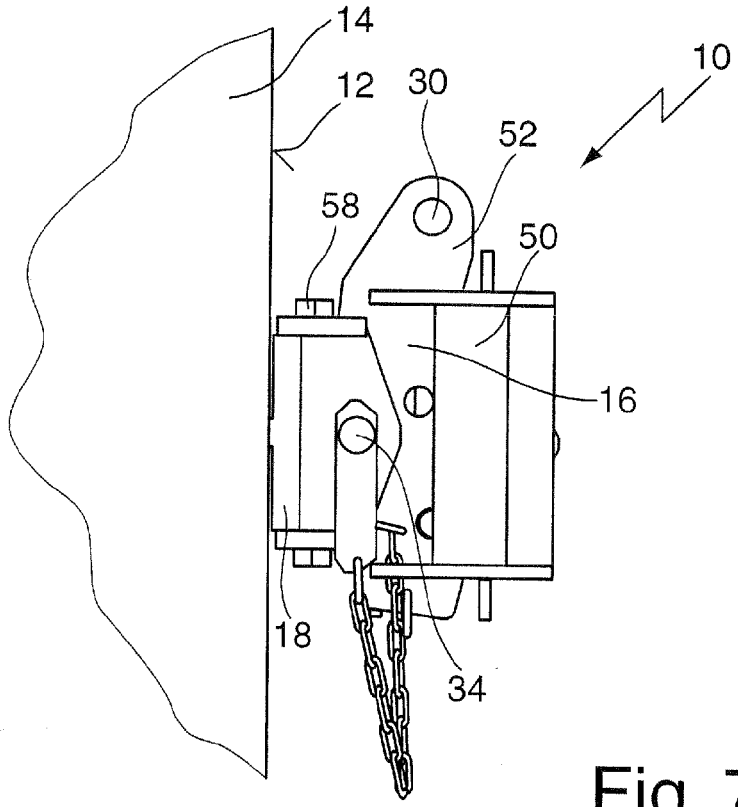
FIG. 7 shows a side view of a climbing shoe as fixed on the wall of a concreting section in a fixed position with a cardanic mounting about a horizontally and vertically aligned axis.

FIG. 7 shows a side view of a cardanically mounted climbing shoe 10 on the wall 12 of the concreting section 14. The sliding shoe part 16 is connected to the wall shoe part 18 in an articulated manner in the horizontal direction by means of the stub shaft 34. In addition to the climbing shoes from FIGS. 1 to 6, the wall shoe part 18 has a vertically aligned axis 58 about which the wall shoe part 18 with the sliding shoe part 16 can be pivoted out if necessary. The tab 52 carrying the articulated shaft 30 is formed on the sliding shoe part 16. The claws 50 cover the catches disposed between the claws 50.

Figure 8:
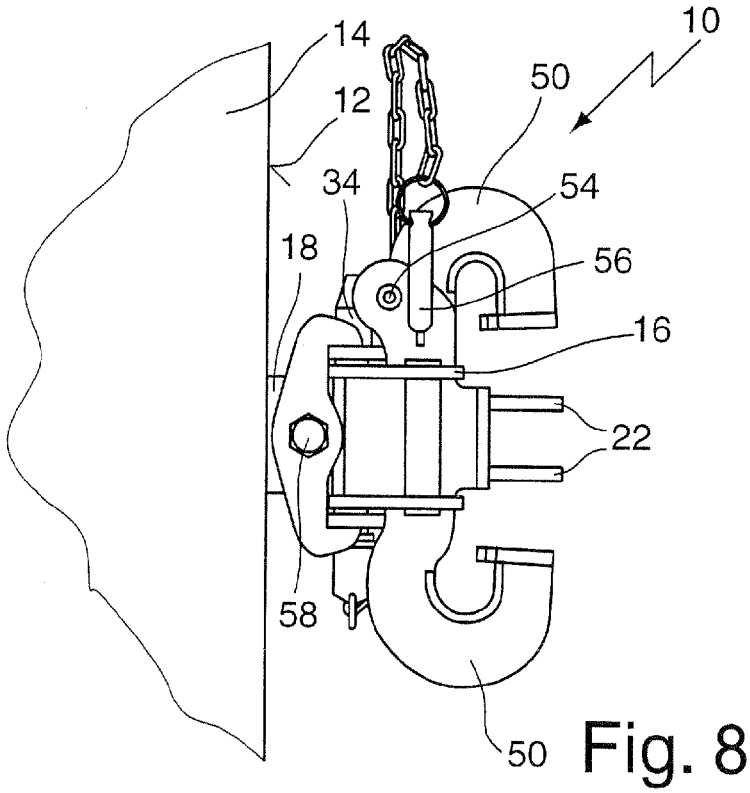
FIG. 8 shows a plan view of a climbing shoe according to FIG. 7.

FIG. 8 shows the cardanically mounted climbing shoe 10 from FIG. 7 in plan view. The climbing shoe 10 is held in a fixed position on the wall 12 of the concreting section 14 and can pivot about the vertically aligned axis 58 and about the horizontally aligned axis formed by the stub shaft 34. The sliding shoe part 16 is pivotally held on the wall shoe part 18 by means of the stub shaft 34 and the wall shoe part 18 can pivot into itself by means of the axis 58. A claw 50 is pivotally mounted about the axis 54, the locking bolt 56 making a rigid claw connection between the sliding shoe part 16 and the pivotable claw 50 when in place. The pivotable catches 22 are arranged between the claws 50 in the sliding shoe part 16.

Figure 9:
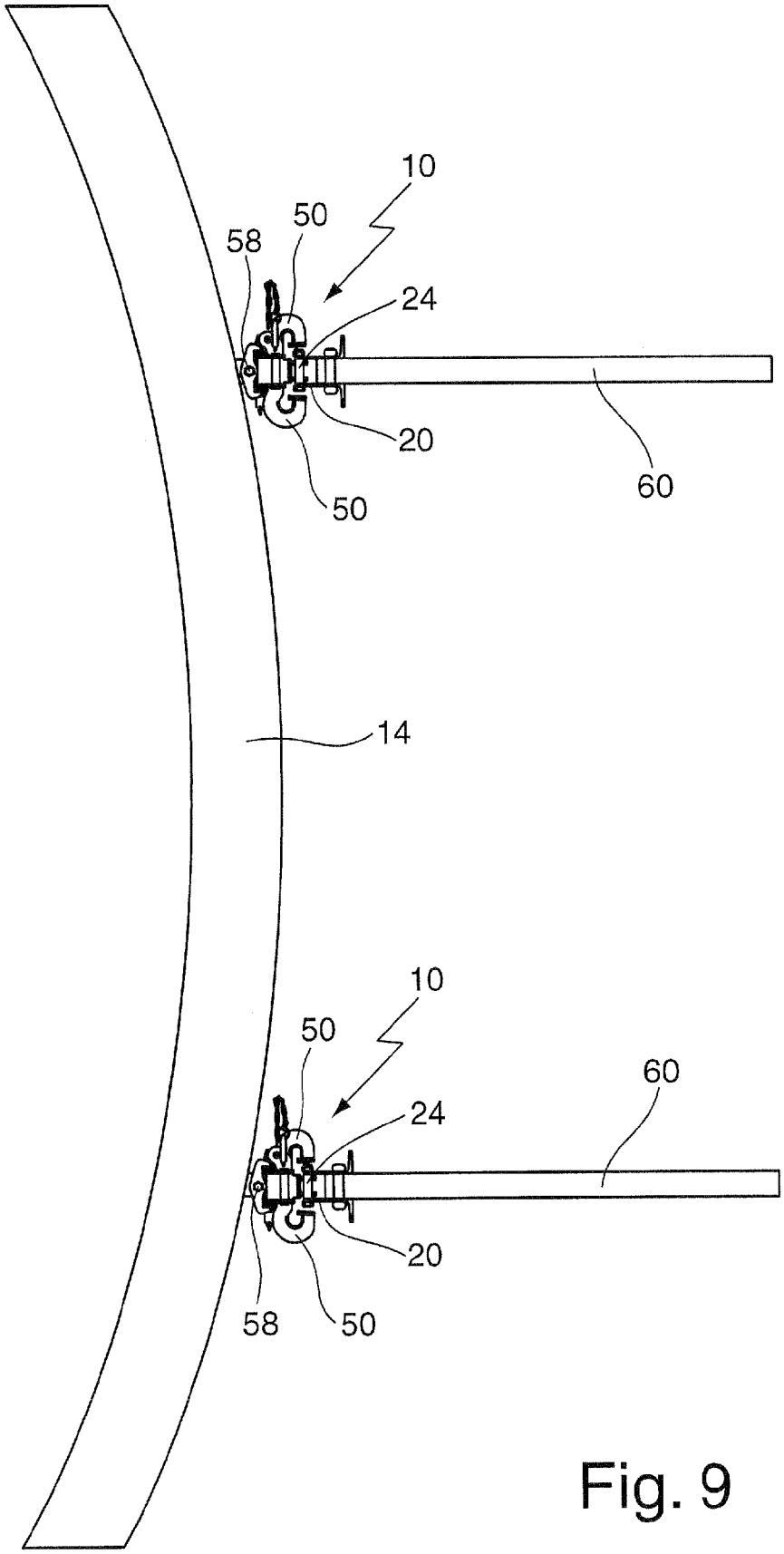
FIG. 9 shows cardanically mounted and positionally fixed climbing shoes on a convexly formed wall of a concreting section with climbing rails which hold consoles or rail elements aligned in parallel.

FIG. 9 shows a plan view of a concreting section 14 which is configured as rounded. The climbing shoes 10 are fixed at anchor points provided on the concreting section 14, each guiding a climbing rail 20 between the claws 50 and the climbing rails 20 are held in position by means of the bearing bolts 24 provided in the climbing rails 20 by means of the catches disposed in the climbing shoes 10. Consoles or rails 60 are fixed on the climbing rails 20 and always run in parallel alignment on the concreting section 14 by means of the cardanically mounted climbing shoes 10. If the consoles or rails 60 are always in parallel alignment even when the curvatures of the concreting section 14 vary widely, formwork carriages can be moved towards the concreting section 14 or moved away from the concreting section 14 by means of the rails 60. The climbing shoes 10 with the climbing rails 20 are always aligned by means of the vertically aligned axes 58 so that the consoles 60 or rails run parallel to one another and this is independent of the radius of curvature of a concreting section 14.

A climbing shoe 10 of a climbing formwork for fixing on a concreting section 14 of a building comprises a sliding shoe part 16 on which claws 50 are provided. At least one claw 50 is provided pivotally and/or telescopically on the sliding shoe part 16.

I claim:

1. A climbing shoe of a climbing formwork for fixing to a concrete section of a building wall, the wall having a substantially vertical front surface, the climbing shoe structured to cooperate with a climbing rail having bolts directly connecting two beams, the climbing shoe comprising:

a wall shoe part structured for direct attachment to the front surface of the wall;

a sliding shoe part;

a connecting element disposed between and cooperating with said wall shoe part and said sliding shoe part, wherein said connecting element comprises a stub shaft for detachable connection of said sliding shoe part to said wall shoe part, said stub shaft having a major longitudinal axis, said wall shoe part, said sliding shoe part and said stub shaft each being structured such that said major longitudinal axis of said stub shaft is substantially horizontal and parallel to the front surface of the wall when said wall shoe part is attached to that front surface, wherein said wall shoe part, said sliding shoe part and said connecting element are further structured such that removal of said connecting element detaches said sliding shoe part from said wall shoe part;

a first claw disposed on said sliding shoe part;

a second claw disposed on said sliding shoe part and facing said first claw, said first and said second claws being structured to embrace and guide the climbing rail for displacement of the climbing rail in a substantially vertical direction, said second claw being structured to pivot or telescope relative to said sliding shoe part for inserting or removing the climbing rail, wherein said wall shoe part, said sliding shoe part, said first claw and said second claw are structured to permit removal of said sliding shoe part from engagement with said wall shoe part and from engagement with the climbing rail subsequent to said pivoting or telescoping of said second claw out of engagement with the climbing rail and following removal of said connecting element, the sliding shoe part structured to be removed from in between the beams of the climbing rail and the wall shoe while said climbing rail is adjacent to said wall shoe during use.

2. The climbing shoe of claim 1, wherein said second claw is fixed pivotally on said sliding shoe part.

3. The climbing shoe of claim 2, further comprising a locking bolt, said locking bolt being disposed, structured and dimensioned to block pivoting movement of said second claw, both in a closed and in a pivoted-out state of said second claw.

4. The climbing shoe of claim 1, wherein said wall shoe part has two sections pivotable with respect to each other via a vertically aligned axis.

* * * * *